United States Patent [19]

Audeh

[11] Patent Number: 4,966,684

[45] Date of Patent: Oct. 30, 1990

[54] PROCESS FOR THE REMOVAL OF MERCURY FROM NATURAL GAS CONDENSATE

[75] Inventor: Costandi A. Audeh, Princeton, N.J.

[73] Assignee: Mobil Oil Corporation, Fairfax, Va.

[21] Appl. No.: 343,659

[22] Filed: Apr. 27, 1989

[51] Int. Cl.[5] ..... C01G 13/00; C07C 7/148; C10G 29/02

[52] U.S. Cl. ..... 208/251 H; 208/251 R; 208/293; 423/101; 585/811

[58] Field of Search ..... 423/210, 101, 102; 585/811, 826, 841, 856; 208/251 R, 251 H, 252, 253, 293

[56] References Cited

U.S. PATENT DOCUMENTS

| | | | |
|---|---|---|---|
| 2,905,636 | 9/1959 | Watkins et al. | 208/251 H |
| 4,044,098 | 8/1977 | Miller et al. | 423/210 |
| 4,430,206 | 2/1984 | Rankel | 208/252 |
| 4,764,219 | 8/1988 | Yan | 423/210 |
| 4,915,818 | 4/1990 | Yan | 208/251 R |

*Primary Examiner*—Jeffrey E. Russel
*Assistant Examiner*—Brian M. Bolan
*Attorney, Agent, or Firm*—Alexander J. McKillop; Charles J. Speciale

[57] ABSTRACT

A process for the removal of mercury from natural gas condensate wherein the natural gas condensate is passed over a catalyst, while also passing a stream of methane containing hydrogen sulfide over the catalyst.

15 Claims, No Drawings

PROCESS FOR THE REMOVAL OF MERCURY FROM NATURAL GAS CONDENSATE

BACKGROUND OF THE INVENTION

The present application is directed to a process for the removal of impurities from natural gas condensate, and particularly, to a process for the removal of mercury from natural gas condensate.

Natural gas which is produced from a natural gas well is typically separated into components, which are in turn purified to provide products for a variety of end uses. The high-pressure mixture produced from the well, i.e., the wellstream, is typically sent to a separator vessel or a series of separator vessels maintained at progressively lower pressures where the wellstream is separated into a gaseous fraction and a liquid fraction.

The gaseous fraction leaving the separator, which may contain the impurities mercury, carbon dioxide and hydrogen sulfide, is sent to a gas treatment and purification plant where typically the mercury concentration is reduced to $<0.1$ micrograms/$m^3$, the $CO_2$ concentration is reduced to the parts per million (ppm) level, and the $H_2S$ to about one (1) ppm.

The liquid fraction is typically preheated, e.g., to 150° C., to affect partial vaporization and is then separated, for example, in a stabilizer column. In the upper section of the stabilizer column, the stream is rectified, i.e., the heavy hydrocarbons are removed from the vapor phase, and in the lower section of the stabilizer column, the liquid stream is stripped of its light hydrocarbon components. Complete stabilization can be further enhanced by heating the bottom liquid stream of the stabilizer column in a reboiler. The reboiler supplies additional heat in order to reduce the light hydrocarbon content of the liquid. The stabilizer column produces two streams, a stream which leaves the top of the stabilizer column containing low molecular weight hydrocarbons, e.g., $C_1$–$C_4$, and other gases and a stabilized condensate stream which leaves the bottom of the stabilizer column.

It has been found that the mercury in wellstreams from gas producing wells which contain mercury is partitioned among the gaseous and liquid streams. This mercury is thought to originate from the geologic deposits in which the natural gas is entrapped.

Typical steps for the processing of the liquid fraction of the wellstream do not reduce the amount of mercury in the liquid fraction leaving the separator. For example, a liquid fraction leaving the separator(s) having a mercury content of about 220 μg/kg(ppb) will yield a stabilized condensate containing about 220 μg/kg(ppb). The presence of this mercury in a natural gas condensate is undesirable and can cause damage to downstream processing equipment.

Equipment damage may result when mercury accumulates in equipment constructed of various metals, especially aluminum, by forming an amalgam with the metal. For example, in the production of ethylene, a natural gas condensate is commonly passed through a heat exchanger constructed of aluminum. Such equipment exists in the section of the ethylene manufacturing facilities where ethylene is separated from hydrogen, ethane and other hydrocarbons by chilling. It has been found that mercury tends to amalgamate with the aluminum of which the heat exchanger is constructed thereby creating the risk of corrosion cracking with potentially catastrophic results.

SUMMARY OF THE INVENTION

The present invention minimizes the potential risk of mercury damage to expensive downstream processing equipment by reducing the amount of mercury in the natural gas condensate. The present invention comprises a process for the removal of mercury from natural gas condensate wherein the natural gas condensate is passed over a catalyst, while also passing a stream of methane containing hydrogen sulfide over the catalyst. The present invention minimizes the risk of equipment failure by providing a process for the removal of mercury from natural gas condensates. Also, since the equipment required to practice the present invention commonly exists in the plants of end users of natural gas condensate, large capital expenditures may be unnecessary.

DETAILED DESCRIPTION OF THE INVENTION

In order to minimize the potential damage to expensive processing equipment which may result from the processing of natural gas condensate containing high levels of mercury, the present invention provides a simple and relatively inexpensive process for removing mercury from natural gas condensate. It has been found that the amount of mercury in a natural gas condensate can be substantially reduced by the process of the present invention which comprises mixing hydrogen sulfide with a carrier/stripping gas, e.g., methane, and then passing this mixture and the condensate into a reactor containing a catalyst.

The catalyst may be any hydrodesulfurization (HDS) catalyst known in the art, for example, Co/Mo, Ni/Mo, etc. The catalyst can be formed in any conventional manner such as by depositing a cobalt/molybdenum salt on a solid support, impregnating the solid with aqueous solutions of the desired cobalt and molybdenum salts, and then evaporating the water to dry the catalyst. The solid can be any suitable solid for the forming of a cobalt/molybdenum catalyst, for example alumina, zirconia, silica-alumina, etc. Suitable catalysts typically have large surface areas, e.g. 200 square meters per gram, and large pores, preferably at least about 20 angstroms. Such cobalt/molybdenum catalysts are well known in the art and, therefore, will not be described in further detail herein.

The $H_2S$ can be mixed with the carrier/stripping gas in any conventional manner such as in a mixing-T. The amount of $H_2S$ in the carrier/stripping gas can be relatively low, e.g. in the ppm range, and still successfully carry out the process of the present invention. Of course, the carrier/stripping gas can also contain $H_2S$ in the percent (by volume) range. For example, the mixture may comprise about 20 ppm to about 50% by volume $H_2S$.

In practicing the process of the present invention, the catalyst is placed in a conventional reactor, such as a carbon steel reactor, and the mixture of carrier/stripping gas and hydrogen sulfide, as well as the natural gas condensate, are fed into the reactor and allowed to flow over the catalyst. The mercury in the condensate reacts with the hydrogen sulfide according to the following formula:

$$H_2S + Hg \rightarrow HgS + H_2 \uparrow$$

and resulting HgS is readily absorbed by the catalyst.

The present invention advantageously operates successfully over a range of temperatures and pressures. The pressure in the reactor can be set from about 5 to 40 atmospheres and is preferably from about 10 to 15 atmospheres. The temperature in the reactor can range from about 100° -300° C, and is preferably from about 200° -250° C. The space velocity, i.e. the volume of liquid flowing through the reactor every hour divided by the volume of catalyst is preferably kept below about 20. Suitable feed ratios of the condensate-hydrogen sulfide mixture to the carrier/stripping gas also cover a wide range such as from 1:600 to 1:1200 and are preferably are in the range of from about 1:600 to 1:750.

As stated above, the carrier/stripping gas, which is used to carry the $H_2S$ into the reactor, also removes the $H_2S$ from the condensate and can be any suitable gas which is non-reactive and inert with respect to the other components of the reaction under the stated reaction conditions such as methane, ethane, nitrogen, hydrogen, argon, helium, etc. Methane may be particularly suitable because it is often readily available in plants which use natural gas condensate.

The stream leaving the reactor contains the condensate with a reduced amount of mercury, the methane gas, and the $H_2S$. In order to separate these components, the pressure of the stream is reduced thereby allowing the methane to leave the condensate. At this point in the process, the methane also serves to remove the non-reacted $H_2S$ from the condensate. In commercial production, the methane may be recycled or sent for further processing.

While not always necessary, in a preferred embodiment of the present invention, the catalyst is pre-sulfided before introducing the methane-$H_2S$ mixture and/or natural gas condensate into the reactor. The catalyst can be pre-sulfided by preheating the catalyst to about 250–400° C. and then passing an inert gas containing hydrogen sulfide, for example 4–5% hydrogen sulfide, over the catalyst at atmospheric pressure.

It will appreciated by those skilled in the art that the natural gas condensate which is treated in accordance with the present invention typically comprise, in addition to mercury, trace amounts of nickel, vanadium, salt, moisture and sediment.

The process of the present invention has been successful in reducing the amount of mercury in natural gas condensate from above about 200 ppb to below about 20 ppb. It will be appreciated by those skilled in the art that the mercury content of the natural gas condensate can be determined by conventional methods, such as ASTM method D-3223.

The following example will further illustrate the present invention.

EXAMPLE

A catalyst was prepared as follows: 1 ml (about 0.8 gms) of alumina was impregnated with cobalt and molybdenum salts and was then sulfided. The sulfided catalyst was then placed in a steel reactor equipped with a means for temperature and pressure control, a means of heating, pumps and a recovery system.

Condensate containing 200 ppb mercury and methane containing 0.01% by volume hydrogen sulfide were introduced into the reactor at 125 psig and a temperature of 240° C. The flow rates were:

Condensate 10 ml/hour, methane containing 0.01% by volume hydrogen sulfide, 120 ml/min.

The product leaving the reactor was a mixture of methane, hydrogen sulfide and treated condensate. This mixture was cooled to −10.C to ensure that the light hydrocarbons were not lost from the condensate and to recover the condensate for mercury determination. The gas was purified and vented.

The condensate, after the application of this treatment, had a mercury content of about 10 ppb.

The present invention is particularly suited for removing mercury from small batches of natural gas condensate, for example, a tank car which has been shipped to an end user. Since the process of the present invention can be practiced using conventional equipment, e.g. hydroprocessing equipment, which is found in the plants of many end users of natural gas condensate, with only minor modifications, large capital expenditures can be avoided. The present invention thereby provides an economical process for the removal of mercury from natural gas condensate.

I claim:

1. A process for the removal of mercury from natural gas condensate comprising the steps of:

passing said natural gas condensate over a catalyst in a reactor vessel and simultaneously passing a mixture of methane and hydrogen sulfide over said catalyst.

2. A process according to claim 1 wherein said catalyst is presulfided by passing hydrogen sulfide over said catalyst prior to passing said condensate and said mixture over said catalyst.

3. A process according to claim 1 wherein said reactor vessel is maintained at a pressure of about 5–40 atmospheres.

4. A process according to claim 1 wherein said reactor vessel is maintained at a pressure of about 10–15 atmospheres.

5. A process according to claim 1 wherein said reactor vessel is maintained at a temperature of about 100–300° C.

6. A process according to claim 1 wherein said reactor vessel is maintained at a temperature of about 200–250° C.

7. A process according to claim 1 wherein the volume of said condensate passing over said catalyst every hour divided by the volume of said catalyst is below about 20.

8. A process according to claim 1 wherein said mixture comprises between about 20 ppm–50% by volume hydrogen sulfide.

9. A process according to claim 1 wherein said mixture comprises between about 0.2–0.5% by volume hydrogen sulfide.

10. A process for the removal of mercury from natural gas condensate comprising the steps of:

passing said natural gas condensate over a cobalt/molybdenum catalyst in a reactor vessel which is maintained at a pressure of about 5–40 atmospheres and a temperature of about 100°–300° C., and simultaneously passing a mixture of methane and hydrogen sulfide comprising about 20 ppm–50% by volume hydrogen sulfide over said catalyst.

11. A process according to claim 10 wherein said catalyst is presulfided by passing hydrogen sulfide over said catalyst prior to passing said condensate and said mixture over said catalyst.

12. A process according to claim 10 wherein said reactor vessel is maintained at a pressure of about 10–15 atmospheres.

13. A process according to claim 10 wherein said reactor vessel is maintained at a temperature of about 200–250° C.

14. A process according to claim 10 wherein the volume of said condensate passing over said catalyst every hour divided by the volume of said catalyst is below about 20.

15. A process according to claim 10 wherein said mixture comprises between about 0.2–0.5% by volume hydrogen sulfide.

* * * * *